US007263930B2

(12) United States Patent
Pershwitz et al.

(10) Patent No.: US 7,263,930 B2
(45) Date of Patent: Sep. 4, 2007

(54) RAILWAY TRUCK SUSPENSION DESIGN

(75) Inventors: Julius I. Pershwitz, Grantham, PA (US); Thomas R. Berg, Warson Woods, MO (US)

(73) Assignee: ASF-Keystone, Inc., Granite City, IL (US)

( * ) Notice: Subject to any disclaimer, the term of this patent is extended or adjusted under 35 U.S.C. 154(b) by 74 days.

(21) Appl. No.: 10/770,463

(22) Filed: Feb. 4, 2004

(65) Prior Publication Data

US 2004/0261654 A1 Dec. 30, 2004

Related U.S. Application Data

(60) Provisional application No. 60/482,133, filed on Jun. 25, 2003.

(51) Int. Cl.
*B61F 3/00* (2006.01)
*B61F 5/00* (2006.01)

(52) U.S. Cl. ..... 105/197.05

(58) Field of Classification Search ..... 105/197.05, 105/198.2, 198.4, 198.5, 197.2
See application file for complete search history.

(56) References Cited

U.S. PATENT DOCUMENTS 3,670,660 A 6/1972 Weber et al.
4,248,318 A * 2/1981 O'Neil ..... 177/137
4,765,251 A * 8/1988 Guins ..... 105/197.05
4,986,192 A * 1/1991 Wiebe ..... 105/198.4
5,524,551 A * 6/1996 Hawthorne et al. ..... 105/198.4

* cited by examiner

*Primary Examiner*—S. Joseph Morano
*Assistant Examiner*—Robert J. McCarry, Jr.
(74) *Attorney, Agent, or Firm*—Oliff & Berridge, PLC

(57) ABSTRACT

A tuned spring group with load springs, control springs, and a frictional damping arrangement for a railcar truck assembly provides better ride quality, increased resistance to suspension bottoming, and increased hunting threshold speed of a railroad car. Specifically, this tuned damping and suspension arrangement provides a spring group reserve capacity of less than 1.50. Spring assemblies for different car types are tuned such that a reserve ratio less than 1.50 may be achieved. By reducing the spring assembly reserve capacity for a railcar and truck of a standard weight and configuration to less than 1.50, an unexpected result of a decrease in maximum vertical acceleration as the railcar truck assembly approaches a speed of 55 miles per hour is achieved. The decrease in vertical acceleration allows for improved ride quality, increased resistance to suspension bottoming and increased hunting threshold speed of the railcar.

21 Claims, 15 Drawing Sheets

44
38
40
16
32
62
15
36
13
12

58
60
61
63
32

TRACK SURFACE VARIATION FOR PITCH AND BOUNCE

RAILWAY TRUCK SUSPENSION DESIGN

CROSS-REFERENCE TO RELATED APPLICATIONS

This is a non-provisional application claiming priority under 35 U.S.C. §119(e) to U.S. Provisional Application Ser. No. 60/482,133, filed on Jun. 25, 2003, incorporated herein by reference in its entirety

BACKGROUND OF THE INVENTION

1. Field of Invention

The present invention relates to an improved suspension system in a wheel-truck assembly for supporting a railcar that allows improved ride quality, increased resistance to suspension bottoming, and increased hunting threshold speed of a railroad car.

2. Description of Related Art

The opposed ends of a railcar body are commonly supported on spaced-apart wheel-truck assemblies for travel along a railway track. A standard railcar wheel-truck assembly generally has a laterally spaced pair of sideframes which are longitudinally operable along the tracks and parallel to the longitudinal axis of the railcar. A bolster, which is transversely positioned to the longitudinal direction of the railcar, couples the sideframes and has the car body supported on bolster center plate sections. A railcar wheel-truck, or truck, is positioned at the opposed ends of the railcar to support it during its traversal of the rail tracks.

Each sideframe includes a window portion for bolster ends and spring groups supporting the bolster, which allows bolster movement relative to the sideframe. Each spring group typically includes a plurality of coil springs extending between a sideframe spring seat portion and an undersurface of the bolster end spaced above the respective sideframe spring-seat.

Railway track conditions can include rail running surface variations or discontinuities from differential settling of track on its ballast, rail wear, corrugations, rail misalignment, worn switch frogs or misaligned switch points, as well as the intersection of rails for flange clearance, switches where switching points match with running rails, and rail joints. During normal railcar usage or operation, these and other variations can result in wheel-truck oscillations, which may induce the railcar body to bounce, sway, rock or engage in other unacceptable motions. Wheel-truck movements transferred through the suspension system may reinforce and amplify the uncontrolled motions of the railcar from track variations, which action may result in wheel-truck unloading, and a wheel or wheels of the truck may lift from the track.

The Association of American Railroads (AAR) establishes the criteria for railcar stability, wheel loading and spring group structure. These criteria are set or defined in recognition that railcar body dynamic modes of vibration, such as rocking of sufficient magnitude, may compress individual springs of the spring group at alternate ends of the bolster, even to a solid or near-solid condition. This alternate-end spring compression is followed by an expansion of the springs, which action-reaction can amplify and exaggerate the "apparent" wheel loading on the suspension system and subsequent rocking motion of the railcar, as opposed to the actual or "average" weight or load from the railcar and therein. As a consequence of the amplified rocking motion, and at large amplitudes of such rocking motion, the contact force between the rails and the wheels can be dramatically reduced on the alternate lateral sides of the railcar. In an extreme case, the wheels can elevate and misalign from the track, which enhances the opportunity for a derailment.

There are various modes of motion of a railcar body, that is bounce, pitch, yaw, and lateral oscillation, as well as the above-noted roll. In car body roll, or twist and roll as defined by the AAR, the car body appears to be alternately rotating in the direction of either lateral side and about a longitudinal axis of the railcar. Car body pitch can be considered a forward to rearward rotational motion about a transverse railcar axis of rotation, such that the railcar may appear to be lunging between its forward and reverse longitudinal directions. Car body bounce refers to a vertical and linear motion of the railcar. Yaw is considered a rotational motion about a vertical axis extending through the railcar, which gives the appearance of the car ends moving to and fro as the railcar moves down a track. Finally, lateral stability is considered an oscillating lateral translation of the car body. Alternatively, truck hunting refers to a parallelogramming or warping of the railcar truck, not the railcar body, which is a separate phenomena distinct from the railcar body motions noted above. All of these motion modes are undesirable and can lead to unacceptable railcar performance, as well as contributing to unsafe operation of the railcar.

A common apparatus utilized to control the dynamic responses of railcar trucks and bodies is a friction shoe assembly, which provides bolster-to-sideframe damping of oscillating motion. Friction shoes include a friction wedge in a pocket, which wedge is biased to maintain frictional engagement. Friction shoes dissipate suspension system energy by frictionally damping relative motion between the bolster and sideframe.

Friction shoes are most generally utilized with constant or fixed bias frictional damping structures with the friction shoe contacting complementary inner surfaces of the pockets. A retention or control spring, which biases the friction shoe and maintains it against the pocket surface and the column wear surface, is supported by a spring base or seat portion within the structure of the pocket. With a fixed or constant bias or damping spring group, the control springs do not carry load and the compression of the friction shoe assembly spring, that is the spring displacement as a function of the force, remains essentially unchanged during relative movement between the bolster and sideframe. Thus, in a constant bias arrangement, the biasing force applied to the friction shoe remains constant throughout the relative motion between the bolster and sideframes for all conditions of railcar loading. Consequently, the frictional force between the friction shoe and column wear surfaces remains relatively constant.

Alternatively, the response of friction shoes in variable bias arrangements varies with the compressed length of the retention spring. Therefore, the frictional force between the friction shoe and the column varies with the vertical movement of the bolster. However, in a variable rate spring structure, the operating range, or the spring rate, of the control spring may not be adequate to respond to the applied forces, that is the railcar weight and the oscillating dynamic forces, from variations in the track and operating conditions. In at least some variable friction force arrangements, the distance between the friction shoe and the sideframe spring seat has been considered to be adequate to accommodate a friction-shoe biasing spring with a suitable design characteristic to handle the force variations and ranges in the railcar wheel-truck assembly, even for railcars with a higher-rated, load-bearing capacity.

In fixed or constant biasing arrangements, the friction shoe frequently has a spring pocket to receive a control spring having adequate length and coil diameter to provide the requisite frictional damping.

The spring group arrangements support the railcar and damp the relative interaction between the bolster and sideframe. There have been numerous types of spring groups utilized for railcar suspension systems, such as concentric springs within the spring group; five, seven and nine spring arrangements; elongated springs for the friction shoe; and, short spring-long spring combinations for the friction shoe within the multi-spring set. These are just a few of the many noted spring arrangements that have been positioned between sideframe and bolster end assemblies. These spring assemblies must conform to standards set by the Association of American Railroads (AAR), which prescribes a fixed spring height for each coil spring at the fully-compressed or solid spring condition. The particular spring arrangement for any railcar is dependent upon the physical structure of the railcar, its rated weight-carrying capacity and the structure of the wheel-truck assembly. That is, the spring group arrangement must be responsive to variations in the track as well as in the railcar such as the empty railcar weight, the laden-to-capacity railcar weight, railcar weight distribution, railcar operating characteristics, available vertical space between the sideframe spring-platform and the bolster end, the specific friction shoe design and, other operating and physical parameters.

Prior spring group designs, such as, for example, U.S. Pat. No. 5,524,551, having a dual rate suspension system, has been limited to minimum reserve capacities of 1.50 per AAR standards S-259 and Rule 88. The only exception of spring group design with an allowed reserved capacity lower than 1.5 is railway cars specifically hauling automobiles, or autorack cars. The weight of the automobiles amounts to about ⅓of the total sprung weight of the loaded autorack cars and the suspension of the antorack cars is much softer than a suspension of the cars. Due to the added suspension of the automobiles, the natural frequency of bounce of the autorack cars splits into two frequencies: a lower frequency and a greater frequency than the natural frequency of bounce of the same car with a fixed load of the same weight. This results in reduction of the amplitudes of bounce in the operating range of speeds. A graph that illustrates how the natural frequency of bounce of an autorack car splits into two frequencies and illustrates a dynamic effect of this split on the amplitudes of the steady-state vibration is shown at FIG. 26.

More specifically, the freight car weight for a bi-level autorack, for example, is about 98,000 pounds. The vehicles shipped will weigh about 40,000 pounds to about 48,000 pounds. Thus, a fully loaded autorack may weigh in the vicinity of about 138,000 pounds to 146,000 pounds. Because of the allowable space available for the vehicles, the autorack could not reach the maximum allowable capacity of 286,000 pounds. Further, the AAR Specification M-950-AA-99 standard requires that the cars be sprung from a maximum capacity of 185,000 pounds.

The reserve capacity may be calculated by dividing the spring group total solid capacity by the total loaded weight less the "unsprung" truck weight divided by the number of spring groups. Thus, where the spring group total solid capacity for autoracks is 47,478 pounds, the total loaded weight is 185,000 pounds, the "unsprung" truck weight is 13,500 pounds and the total number of spring groups is 4, the reserve capacity is equal to 1.1. However, when calculating the reserve capacity for the actual total loaded weight of about 140,000 to 146,000 pounds, the reserve capacity will be greater than 1.4.

Further, additional suspension may be provided via a "swing motion" truck design as disclosed in U.S. Pat. No. 3,670,660. The "swinging" action between the sideframe and the bolster/transom softens the lateral accelerations. However, for higher spring loads and column forces (i.e., snubber springs) the swinging action is inhibited. So the reduced spring reserve capacity for the swing motion truck may be allowable because of the swing action.

Reducing reserve capacity for these types of loads was considered acceptable to improve ride quality of the autorack cars. With the exception of railroad cars hauling automobiles, the AAR minimum reserve capacity of 1.50 was thought to be the minimum allowable spring capacity to prevent suspension bottoming. However, the prior art did not consider the length of the car or the interaction of the suspension systems within a car. The same suspension design and damping was used for all car types.

The railcar must be physically able to bear the rated load weight and maintain contact with the track as the car travels at varying speeds along different track contours with varying track conditions. Simultaneously, the railcar and truck assemblies must have operating characteristics enabling it to be safely operable on these same varying track conditions at the unloaded, empty-car condition. Both operating weight extremes must be accommodated without posing the danger of imminent derailment for either condition.

To provide a railcar with the above-required operating range capabilities, the damping system spring group incorporated into the truck assembly must have certain static and dynamic operating characteristics. That is, operation of a car in motion on a rail track with a wide variant of track and contour conditions can lead to dynamic operating problems from oscillations, which can progress to uncontrolled instabilities of the railcar. Track-to-wheel separation is a result of several conditions, including traversal of rail imperfections, and in conjunction with the oscillation frequency of the car from traversing the non-uniform tracks, disengagement of a wheel of an unloaded railcar is not an unusual condition. Although wheel disengagement from the track does not generally result in a derailment, the implied hazard from such a separation is readily apparent and should be avoided, if possible.

One of the primary methods for dealing with the oscillations of a railcar and truck assembly is the damping from the above-noted friction shoe, as well as the stabilizing effect of the supporting springs. These oscillations may be due in part to the physical track conditions experienced by railway cars during their operation. Variations in track conditions, for example, track joints, can effect operation of the truck assembly, which track variation effects may be amplified as they are transferred through the wheel, axle and suspension to the frame. This may effect operation of the railcar as it traverses the track and encounters more of these track-induced operating problems.

SUMMARY OF THE INVENTION

There is a need for improved spring assemblies that can assist the truck in meeting or exceeding the truck new AAR standards, such as M-976 of the AAR Office Manual.

There is also a need for improved spring assemblies that can improve ride quality.

There is also a need for improved spring assemblies that can provide an increased resistance to suspension bottoming.

There is also a need for improved spring assemblies that can provide increased hunting threshold speed of a railroad car.

There is also a need for redesigned spring rates to improve handling characteristics of the truck and railway car.

There further is a need for tuning of the spring assembly of a railway truck suspension such that spring assembly is adjusted based on the size, weight, and configuration of the specific railway car it is to support.

The above and other advantages are achieved by various embodiments of the invention.

In exemplary embodiments, reserve capacity less than 1.50 of the spring assembly can be achieved by reducing the total number of springs.

In exemplary embodiments, reserve capacity less than 1.50 of the spring assembly can be achieved by replacing the type of springs used.

In exemplary embodiments, improved ride quality, improved suspension and hunting thresholds can be achieved by reducing the reserve capacity to less than 1.50 and increasing and/or decreasing the damping as needed.

In exemplary embodiments, increased life of the parts of a railway car assembly can be achieved by reducing the reserve capacity to less than 1.50 and increasing and/or decreasing the damping as needed.

The present invention provides a spring group with load springs, control springs, and a frictional damping arrangement for a railcar truck assembly. Specifically, this damping and suspension arrangement provides a spring group reserve capacity of less than 1.50 which yields improved ride quality, increased resistance to suspension bottoming, and increased hunting threshold speed of a railroad car.

In the present invention, the railcar suspension arrangement has a spring suspension with a damping assembly for a sideframe-bolster, wheel-truck assembly with a friction shoe for damping a railcar, and general criteria are noted for constructing the damping assembly. In the preferred embodiment of the spring group, there is a reserve capacity less than 1.50 in the spring system to account for perturbations, such as overloading, in excess of the dynamic range for the rated car capacity, and the resultant spring-coil compressions down to the fully compressed, solid-spring state. In dynamic operating motion, the control spring remains loaded. The solid-spring state and the various sizes of the springs are dependent upon AAR specifications and the space available in the various sideframe structures. The specific configuration of a spring group is also determined by the available space and the spring response sought by the railcar manufacturer to maintain railcar stability across the operating weight range.

Decreasing the reserve capacity of the spring assembly to less than the AAR standard of 1.50, for specific railway cars, meets the need for improved ride quality, increased resistance to suspension bottoming, and increased hunting threshold speed of a railroad car. The spring assembly of the present invention, allowing a reserve capacity less than 1.50, allows for a more stable railway car in both empty and loaded conditions.

BRIEF DESCRIPTION OF THE DRAWINGS

The invention will be described with reference to the following drawings, wherein.

DETAILED DESCRIPTION OF PREFERRED EMBODIMENTS

Figure 1:
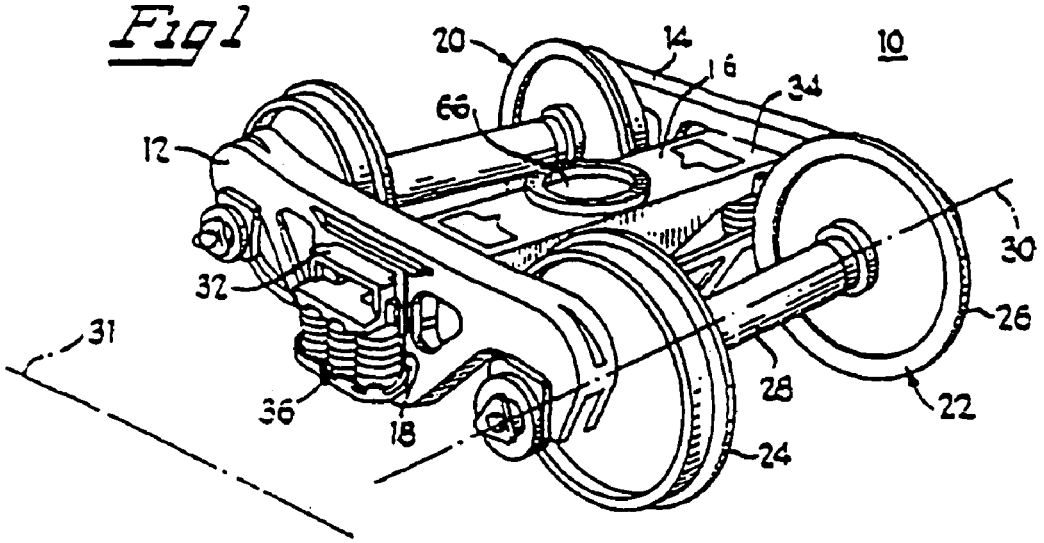
FIG. 1 is an oblique view of a railcar wheel truck assembly.

An exemplary railcar wheel truck assembly 10, as shown in FIG. 1, has a first sideframe 12 and a second sideframe 14, which are arranged in parallel alignment. Transverse bolster 16 couples first and second sideframes 12 and 14 generally at their respective spring windows 18, which are about at the longitudinal midpoint of first and second sideframes 12, 14. First axle and wheel set 20 and second axle and wheel set 22 are positioned at the opposed ends of aligned sideframes 12 and 14. Each of first and second axle and wheel set 20, 22 has an axle axis 30 generally transverse to the longitudinal axis 31 of first and second sideframes 12, 14 and about parallel to bolster 16. Each of first and second wheel sets 20, 22 include wheels 24 and 26 and axle 28 with axle axis 30.

Figure 2:
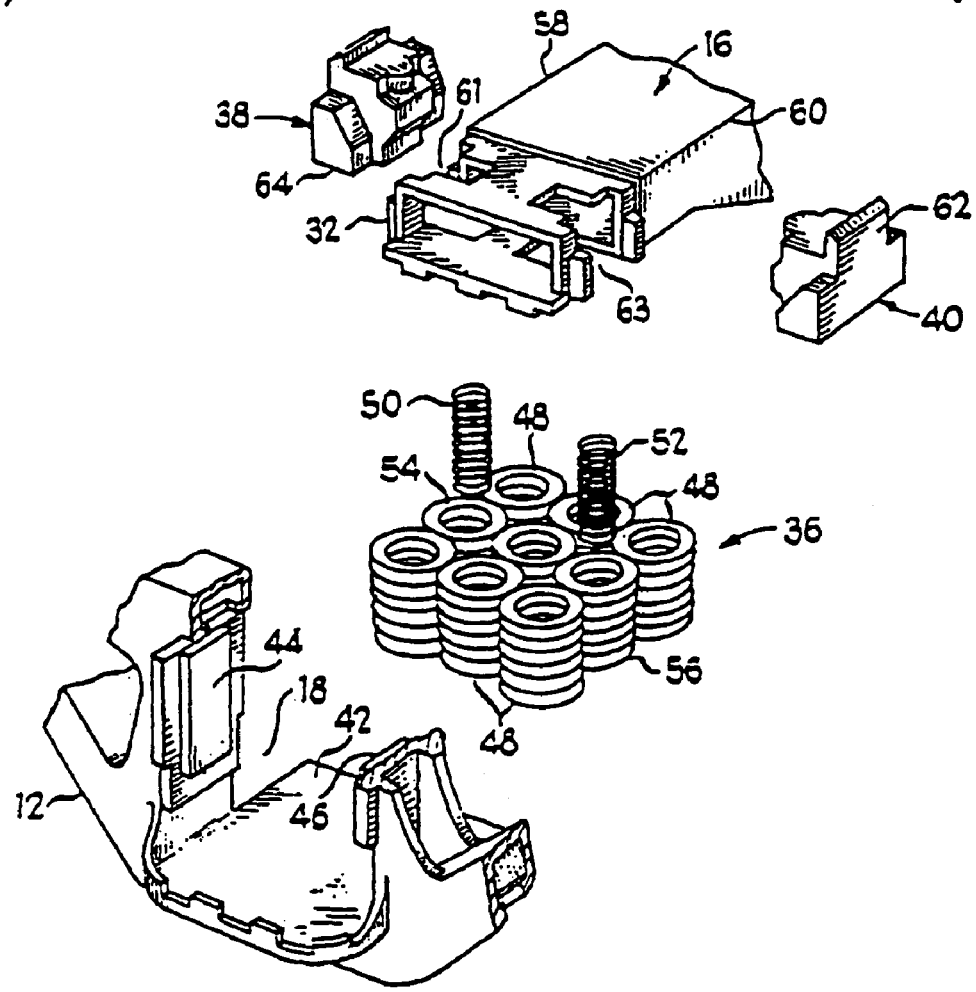
FIG. 2 is an exploded view in partial section of a sideframe, spring group, bolster end and friction shoes at one side of the wheel truck assembly of FIG. 1.

Bolster 16 has first end 32 and second end 34, which respectively extend through windows 18 of first and second sideframes 12 and 14 in FIG. 1. Window 18, bolster end 32, spring group 36, first friction shoe 38 and second friction shoe 40 of sideframe 12 are shown in FIG. 2 in an enlarged, partially sectioned and exploded view. As bolster ends 32 and 34, first and second sideframes 12 and 14, and sideframe windows 18 are structurally and functionally similar, only bolster end 32 at first sideframe 12 will be described, but the description is also applicable to bolster end 34 and window 18 of second sideframe 14.

In FIG. 2, sideframe window 18 has lower support platform 42 with first and second upright side columns or side faces 44 and 46, respectively, extending vertically from platform 42. Spring group 36 is shown as a three by three matrix of load springs 48, 54 and 56. In this matrix, first inner control spring 50 and second control spring 52 are concentrically positioned in outer control springs 54 and 56, respectively, to provide control spring subassemblies, which control springs 50, 52, 54 and 56 are also railcar load-bearing elements. Load springs 48, or load spring subassemblies may include 1, 2 or 3 individual springs concentrically arranged in a manner to meet design criteria or to provide optimum dynamic performance of suspension spring group 36.

The spring group 36 may be tuned by changing the number of springs, arrangement of springs, and/or type of springs. Thus, as used herein, the term "tuned spring group" is defined to mean a spring group that has been modified from a standard spring group design (typically having a reserve capacity of greater than 1.50 in accordance with AAR requirements in effect at the time of the invention herein) by the removal, replacement and/or rearrangement of certain types of springs in the standard group without the addition of any other devices, such as, for example, the addition of hydraulic damping devices, in place thereof within the spring group assembly, which tuning desirably reduces the reserve capacity of the spring group as described herein. For example, the spring group 36 may be tuned to a spring group having a reserve capacity of less than 1.50. Removal of springs involves removing one or more springs of a set of springs or removing a set of springs within the spring group. Replacement of certain types of springs involves replacing one or more springs of a set of springs or replacing a set of springs within the spring group with a different spring or set of springs of, for example, a spring of different stiffness, size, or the like. Examples of tuned spring group assemblies are further discussed below.

Figure 3:
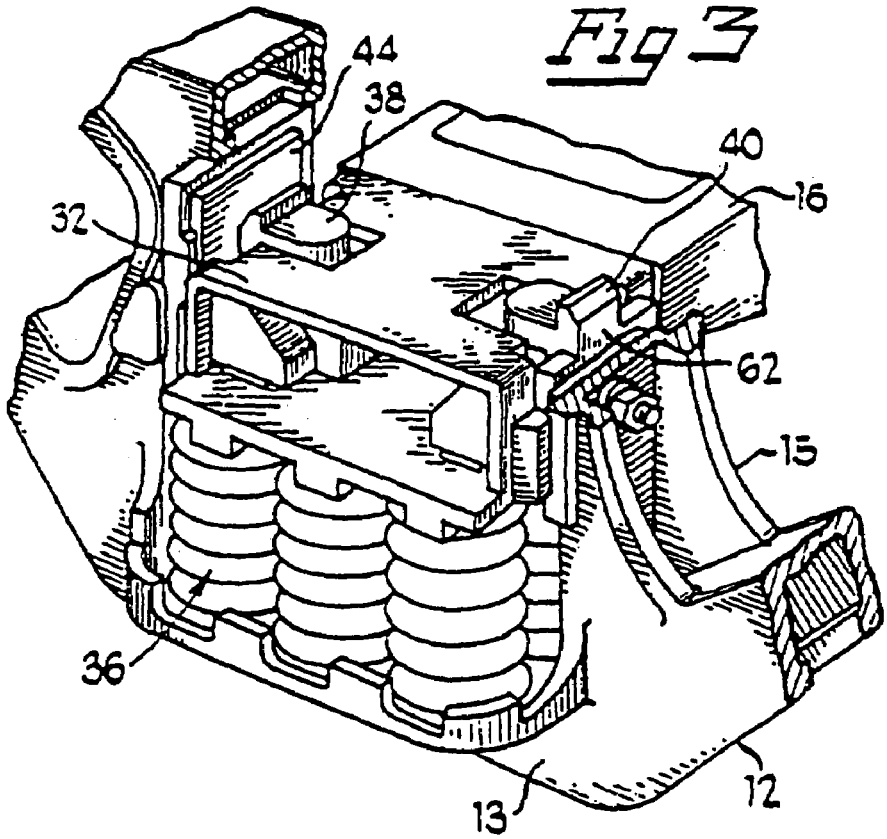
FIG. 3 is an oblique view of the assembled wheel truck assembly section illustrated in FIG. 2.
Figure 4:
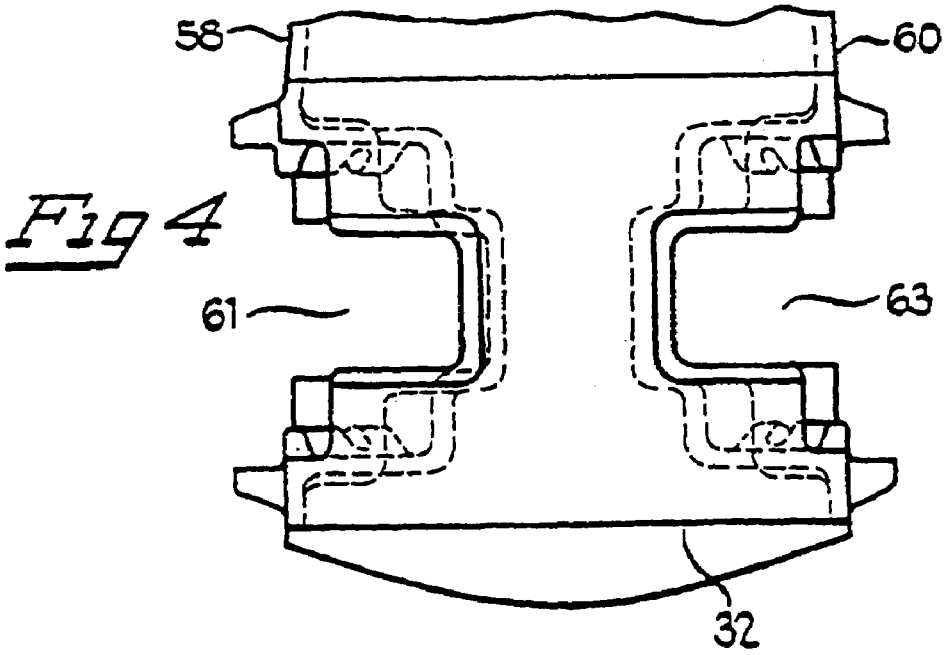
FIG. 4 is a plan view of a bolster end and friction shoe pockets.
Figure 5:
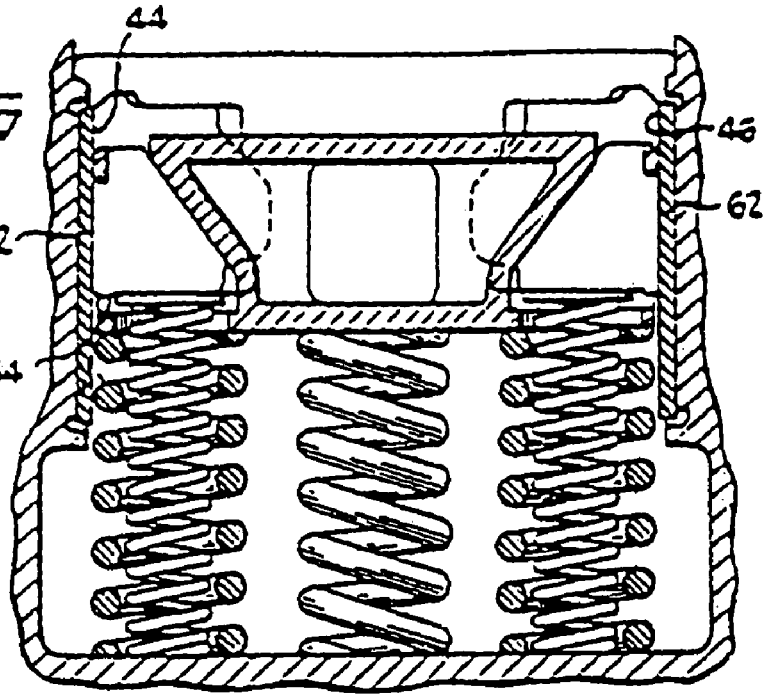
FIG. 5 is an elevational view in section of the spring group, bolster end and friction shoes.

Bolster end 32 in FIGS. 2 and 4 has forward friction shoe pocket 61 at bolster forward edge 58 and rear friction shoe pocket 63 at bolster rear edge 60, which friction shoe pockets 61 and 63 receive first and second friction shoes 38 and 40, respectively, for sliding operation therein. The several elements of sideframe 12, bolster 16 and spring group 36 of FIG. 2 are shown in the assembled form in FIG. 3. In this figure, the interface contact is noted between side column wear face 46 (FIG. 2) and friction face 62 of friction shoe 40. A similar friction face 62 is also present on friction shoe 38 and other friction shoes of wheel trucks. It is the frictional interface action between a friction shoe and a wear face, such as friction shoe 40 and wear face 46, which provides the damping force of the friction shoe. The biasing force applied to friction shoes 38, 40 is provided by control springs 50, 52, 54 and 56, at friction shoe lower surfaces 64, as noted in FIG. 5.

Figure 6:
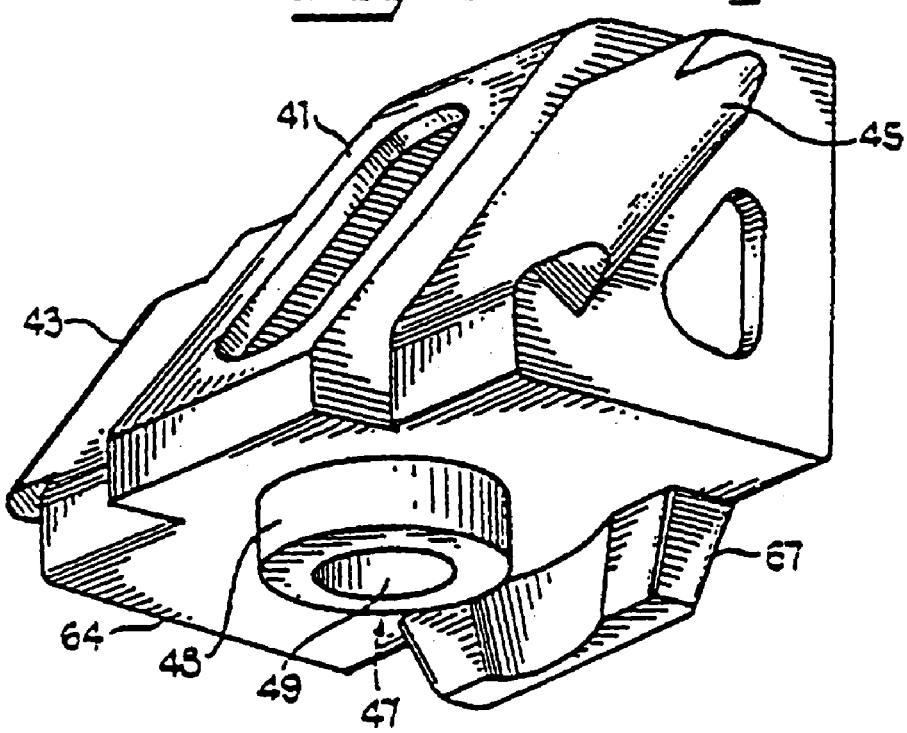
FIG. 6 is a lower elevational oblique view of a friction shoe.

Friction shoes 38, 40 operate as damping devices while sharing the load with the load springs 48. Friction shoe 40 in FIG. 6 is a friction shoe having central portion 41, first wing 43 and second wing 45. Friction shoe central portion 41 is slidably matable with slot 61 or 63 of bolster end 32, as shown in FIG. 4, to maintain friction shoe 40 in position and guide it during its vertical reciprocation as the railcar traverses the rail tracks. However, the biasing operation of control springs, subassemblies or couplets 50, 54 and 52, 56 provide a variable biasing action on their associated friction shoe 38, 40, which accommodates the dynamic operating range of the wheel-truck assembly 10 and car (not shown). In FIG. 6, annular disc or annulus 47, which is generally centrally positioned on lower surface 64, extends from lower surface 64 into control-coil spring 52 to maintain spring 52 in alignment. Spring 52 is in contact with lower shoe surface 64 and biases friction shoe 40 for damping of bolster 12 and truck 10, and thus the railcar.

In normal operation of a railcar, spring group 36 biases bolster 16 and, thus, the railcar supported by bolster 16 at center plate 66. The biasing force controls or accommodates the oscillations or bouncing of the railcar, maintains railcar stability during traversal of the rail tracks and dampens any perturbations from various indeterminate influences, as noted above.

Alternative structures for the friction shoe and the friction shoe with spring group are noted in FIGS. 7A-7E, 8A and 8B. It should be noted that various friction shoe designs can be used with the railway truck suspension design of the present invention.

Figure 7A:
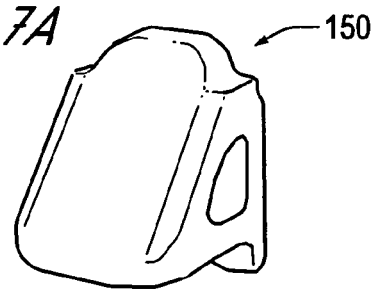
FIG. 7A is an oblique view of an alternate embodiment of a friction shoe.
Figure 7E:
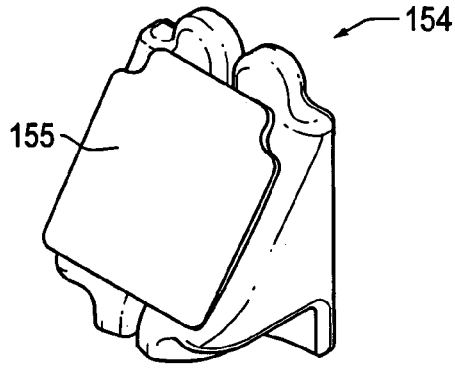
FIG. 7E is an oblique view of the a friction shoe illustrated in FIG. 7D.
Figure 7B:
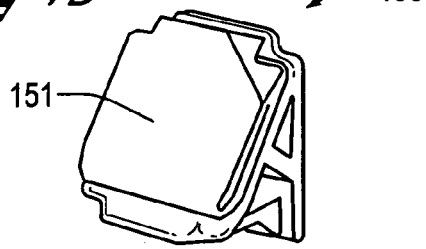
FIG. 7B is an oblique view of an alternate embodiment of a friction shoe.
Figure 7C:
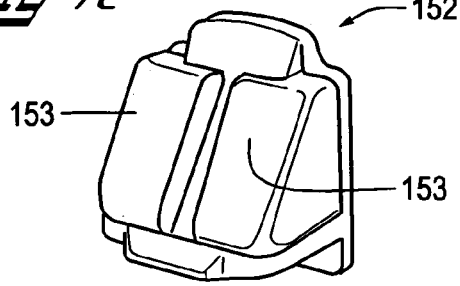
FIG. 7C is an oblique view of an alternate embodiment of a friction shoe.
Figure 7D:
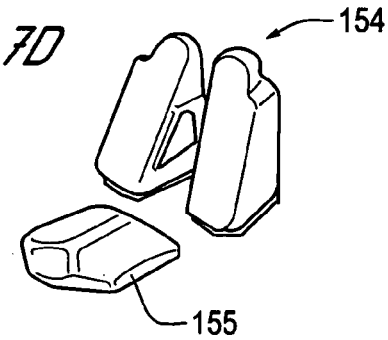
FIG. 7D is an exploded view of an alternate embodiment of a friction shoe.

FIG. 7A illustrates a friction shoe 150 devoid of a double-wing structure. FIG. 7B illustrates the friction shoe 150 with a pad 151. FIG. 7C illustrates an alternate friction shoe 152 with twin pads 153. In FIGS. 7D and 7E, another alternate friction shoe 154 is illustrated having a split wedge structure having an insert 155.

Figure 8A:
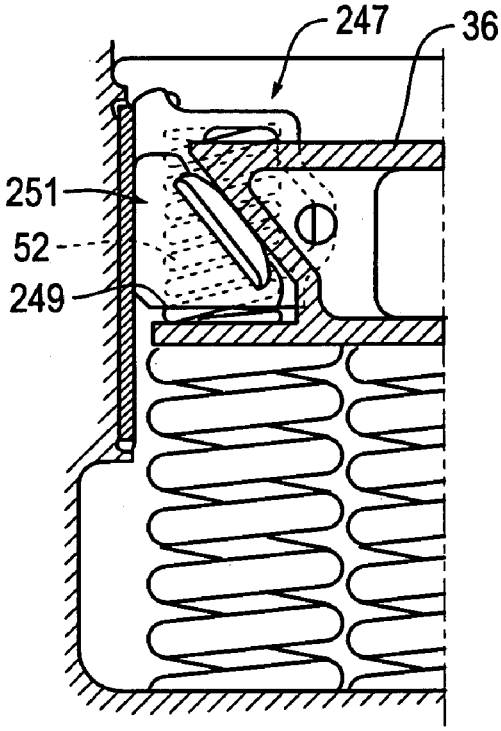
FIG. 8A is an elevational view of a constant bias suspension spring group in a sideframe with a friction shoe.
Figure 8B:
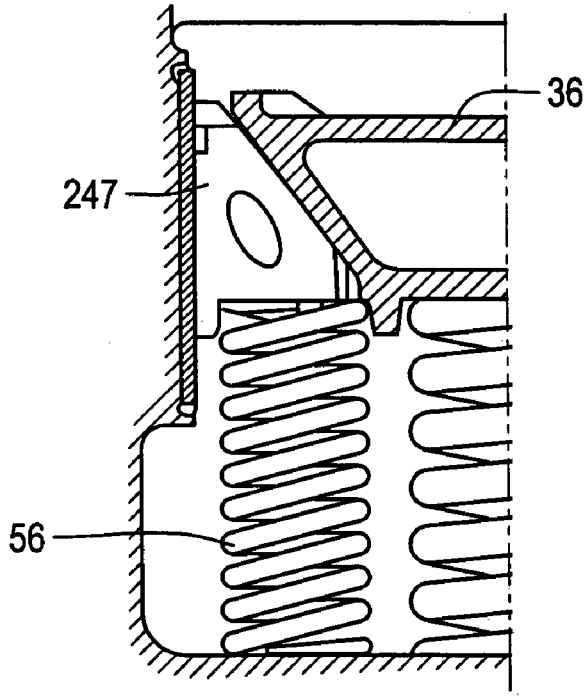
FIG. 8B is an elevational view of a variable bias suspension spring group in a sideframe with a friction shoe.

In FIG. 8A, second alternative friction shoe 247 is noted in an illustrative segment of a constant damped suspension spring group in a sideframe and bolster. In this structure, friction shoe 247 has lower port 249 open to internal chamber 251 of shoe 247. Control spring 52 in chamber 251 biases shoe 247 against bolster 36. In this structure, friction shoe 247 may have any form, such as double-winged or single-sloped face. In FIG. 8B, the second alternative friction shoe 247 is noted in an illustrated variable damped suspension spring group of a sideframe and bolster in another embodiment of the present invention.

Figure 9:
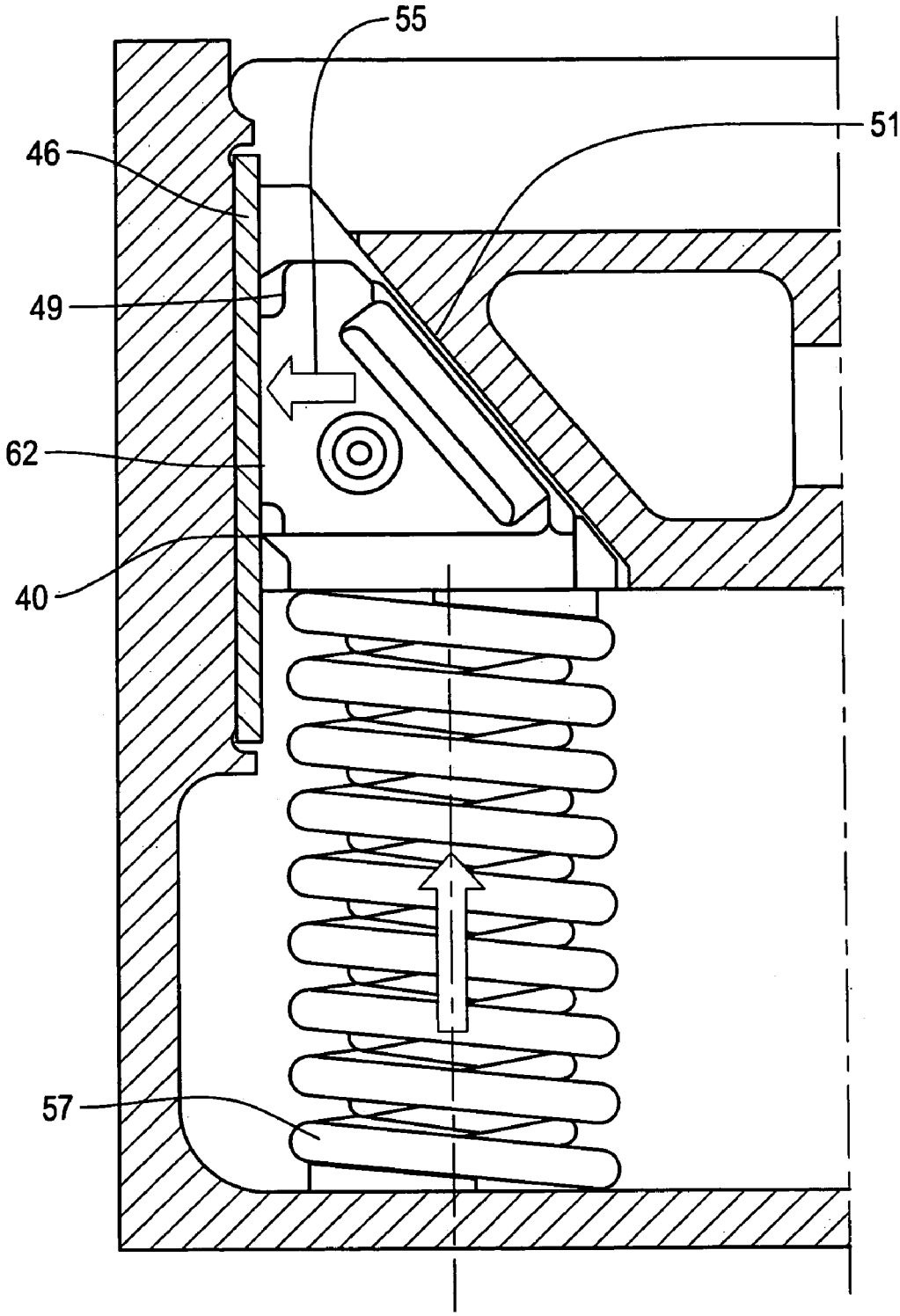
FIG. 9 is an elevational view of a spring group in a sideframe with a friction shoe.

As shown in FIG. 9, typical wear of the elements of the wheel-truck assembly 10 occur on wear face 46, friction face 62, and the friction shoe slope surface 51. Such wear causes the friction shoe to rise within the shoe pocket 63 of the bolster 16. As the friction shoe 40 rises, the control coil 57 decompresses causing a reduction in column load 55. Therefore, the measurement of the friction shoe height is a comprehensive measure of total control element wear. The friction shoe has a visual indicator 49 to determine when the friction shoe should be replaced based on face wear.

The damping action is frequently applied through apparatus, such as friction shoes 38 and 40, operable at the opposed bolster ends 32, 34 and at each forward and rear edge 58, 60. However, it is not simply the application of a biasing force to bolster end 32, 34 and friction shoes 38, 40, but the application of the static load (compressive force on the spring), that is the railcar weight at either an unloaded or fully laden weight. However for any particular railcar, the railcar weight is a variable with a broad range extending from an empty-car, vehicle tare weight to a loaded-to-capacity railcar, and perhaps loaded above the rated, vehicle weight. As the railcar traverses the track, it experiences dynamic compressive forces on the springs, and it is susceptible to all the above-cited track conditions as well as countless others, which could contribute to oscillations. Spring group 36 and friction shoes 38, 40 provide the requisite damping to the railcar and wheel-truck assembly 10 for its safe operation.

Figure 10A:
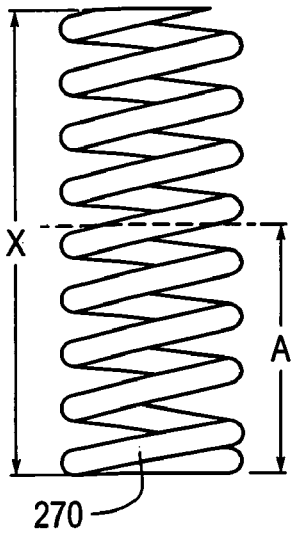
FIG. 10A is an exemplary spring at a spring free-height.
Figure 10B:
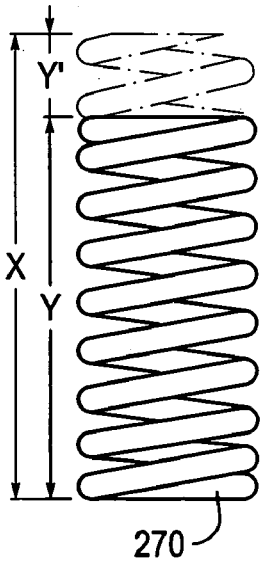
FIG. 10B is the spring of FIG. 10A compressed to a height at an empty-car condition.
Figure 10C:
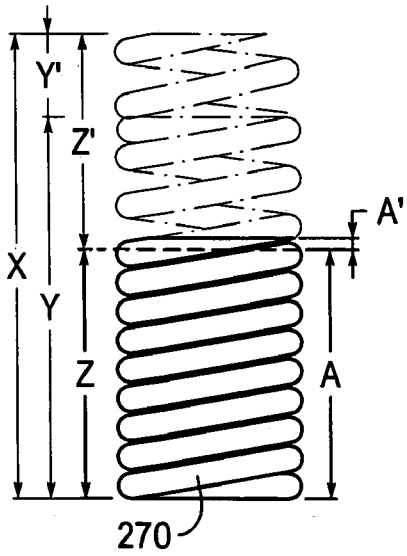
FIG. 10C is the spring of FIG. 10A compressed to a height at a loaded-to-capacity condition.

In FIG. 10A, an exemplary spring 270 is illustrated with spring free-height x and fully compressed or mechanically solid height A. In FIG. 10B, spring 270 has been compressed a compression distance y' to a static empty-car spring height y, and in FIG. 10C, the loaded-to capacity car compresses spring 270 to spring height z with a compressed distance z'. In a dynamic operation, the railcar will oscillate about the static heights, that is it will compress and expand the springs about these static heights. The distance A' in FIG. 10C is the reserve or safety distance designed into springs to accommodate any random car oscillations beyond normal expectations.

The structural and operational conflicts between decreased railcar weight and increased carrying capacity is a primary operating condition, which must be accommodated. Further complicating factors include the standards and specifications set by the AAR for railcars utilized in interchange, that is railcars not dedicated to a single user, which thus fall under the aegis of the AAR. The constraining weight factors lead to the operational constraints for the designer. Although the user wishes to maximize railcar carrying capacity while minimizing railcar weight, safe operational characteristics are a prime concern of both the railcar supplier and user.

Figure 11:
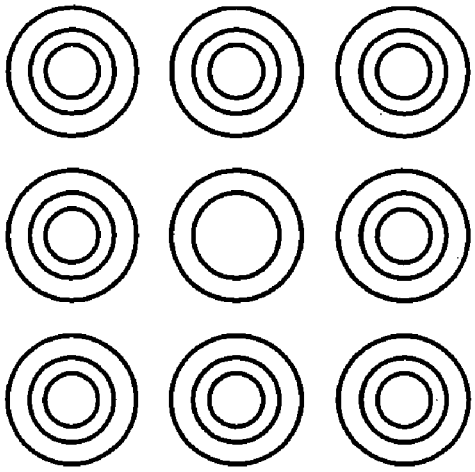
FIG. 11 is a plan view of a standard 9 coil spring group configuration.

Indicative of a railcar suspension and damping structure is spring group 36. The spring rate or response for an individual concentric spring arrangement, as well as the number of required springs of various arrangements needed in a specific spring group 36, will vary for a particular wheel-truck assembly 10 and style of railcar. By changing the number of springs, arrangement of springs, and/or type of springs, the riding quality and hunting threshold is significantly improved. For example, a standard 9 coil spring assembly design that includes nine outer springs and eight inner springs is illustrated in FIG. 11. For a 286,000 lb railcar and truck assembly (not shown) using this standard 9 coil spring assembly design, the column load is 4,744 pounds, the group rate of the springs is 29,143 pounds per inch; the damping force is 2,134 pounds; and the reserve ratio is 1.61. The 1.61 reserve ratio is calculated by dividing the solid spring capacity of the group (108,026 pounds) by the difference between the 286,000 pound standard railcar and the weight of the truck (i.e., 17,000 pounds) then multiplying this value by the number of spring groups (4).

Figure 12:
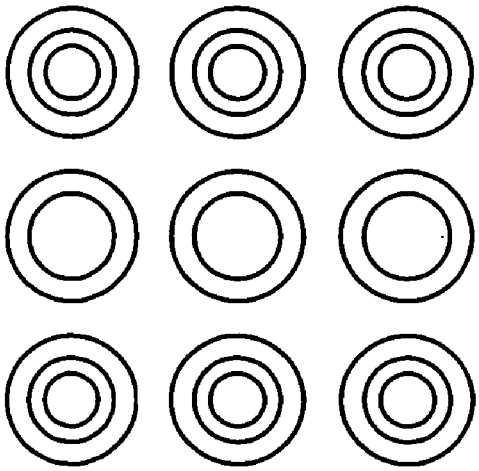
FIG. 12 is a plan view of a 9 coil spring group configuration of a preferred embodiment.

Comparatively, for a tuned design using 9 outer coils and 6 inner coils, as shown in FIG. 12, the column load is 5,996 pounds, the group rate of the springs is 26,061 pounds per inch; the damping force is 2,698 pounds; and the reserve ratio is 1.47. The 1.47 reserve ratio is calculated by dividing the solid spring capacity of the tuned group (99,042 pounds) by the difference between the 286,000 pound standard railcar and the weight of the truck (i.e., 17,000 pounds) then multiplying this value by the number of spring groups (4). The tuned design increases the damping and reduces the spring reserve capacity according to the mass and geometry of the car body and truck location.

Designing the suspension system in this manner requires reducing the reserve capacity to levels less than the AAR standard of 1.50. (Rule 88 of the AAR Office Manual states "Solid spring group capacity must provide a minimum of 1.5 times the sprung spring load based on nominal spring capacity or a minimum of 1.45 if equipped with hydraulic snubbers.) This has been tested on a number of cars and has shown to be a significant improvement in ride quality and hunting threshold.

Figure 13:
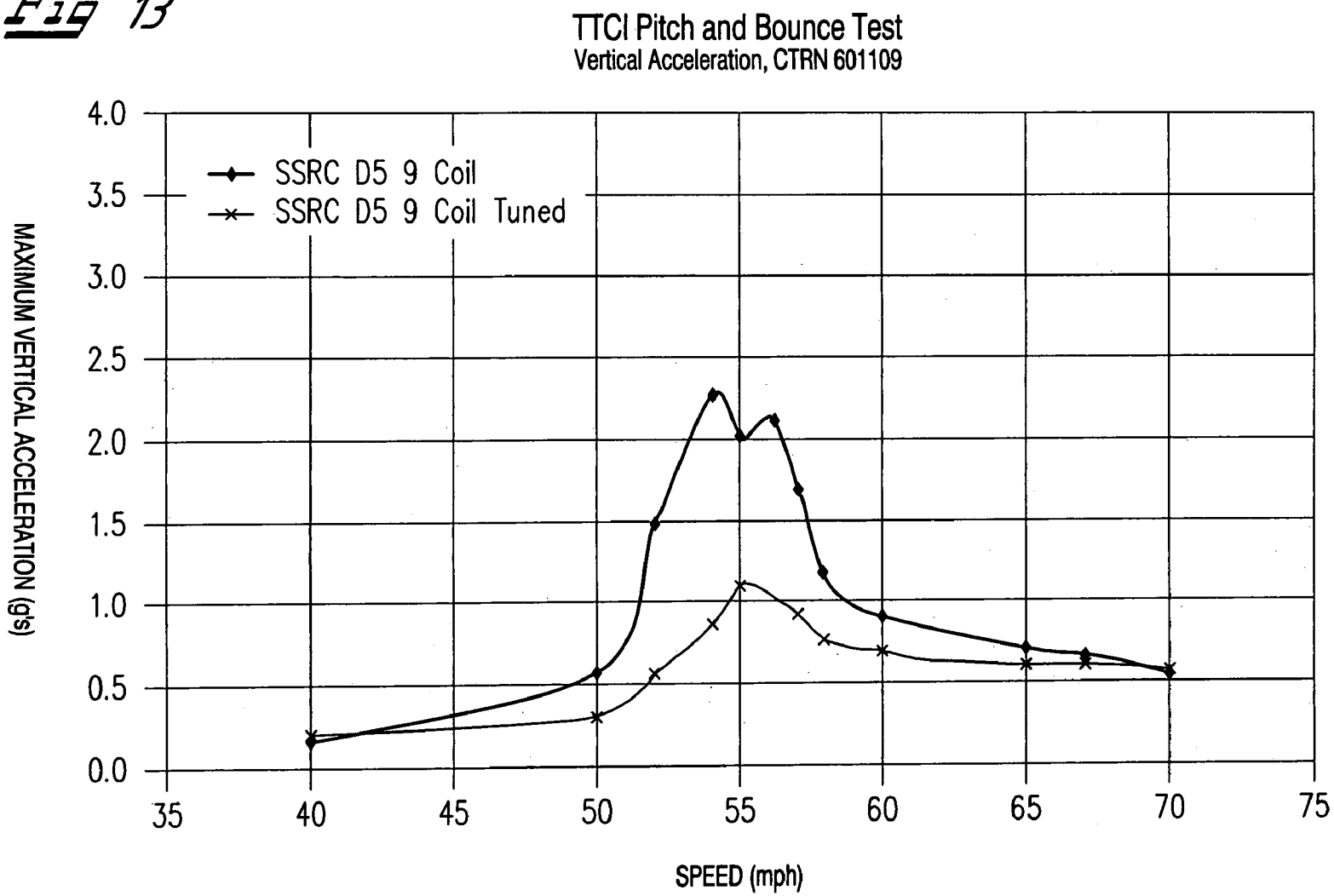
FIG. 13 is a graph of the vertical acceleration shown as a function of speed of the railcar.

Referring to FIG. 13, a chart showing the vertical acceleration of a railway car as a function of its speed is illustrated. As a 286,000 lb railcar and truck with the standard 9 coil spring assembly approaches speeds up to 55 mph, the maximum recorded vertical acceleration approaches 2.5 g's. Comparatively, as a 286,000 lb railcar and truck with the tuned spring assembly design approaches speeds of 55 mph, the maximum vertical acceleration is near 1.1 g's. By decreasing the reserve capacity to less than 1.50, the maximum vertical acceleration is significantly reduced, improving ride quality and hunting threshold. Accordingly, this tuned design meets the improved ride quality, increased resistance to suspension bottoming, and increased hunting threshold speed of a railroad car and is thus a contributing factor in enabling a truck to meet new AAR truck performance specifications M-976, although use of the tuned spring group alone may not be sufficient for the truck to meet such new specifications.

Figure 14:
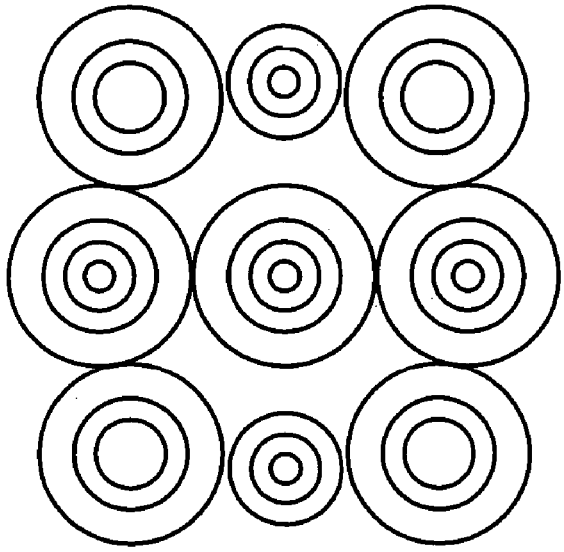
FIG. 14 is a plan view of a standard 7 coil spring group configuration.
Figure 15:
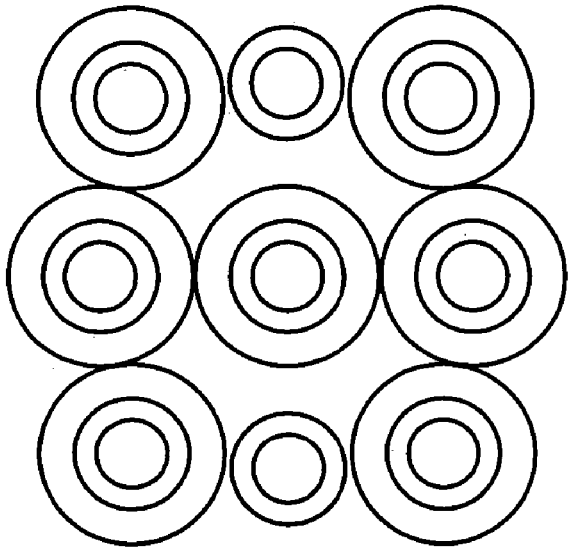
FIG. 15 is a plan view of a 7 coil spring group configuration of a preferred embodiment.

In another embodiment of the present invention, a standard 7 coil spring design assembly is tuned to improve riding quality and hunting threshold. Specifically, a standard 7 coil spring design has 7 outer springs, 9 inner springs and 5 inner-inner springs as shown in FIG. 14. For a 286,000 lb railcar this design has a column load of 4,744 lbs, group rate of 30,562 pounds per inch, a damping force equal to 2,134 pounds and a reserve ratio of 1.57. By removing the inner-inner springs and replacing the control spring, as shown in FIG. 15, for a 286,000 lb railcar, the column load increases to 5,996 pounds, the group rate decreases to 25,781 pounds, the damping force increases to 2,698 pounds, and the reserve ratio decreases to 1.42. Again, a reserve ratio less than 1.50 results in improved riding quality and hunting threshold.

It should be noted that a number of different standard coil spring designs are currently used, such as, for example, assemblies including 1) 9 outer springs with 7 inner springs; 2) 7 outer springs with 7 inner springs, 2 inner-inner springs and double control coils; 3) 7 outer springs with 7 inner springs and double control coils; 4) 7 outer springs with 7 inner springs, 2 inner-inner springs and double side coils; and 5) 6 outer springs with 7 inner springs, 4 inner-inner springs and double side coils. Each of these standard coil spring designs may be tuned as discussed above.

It is important to note that the tuned design is an example of a design for a particular length of car and the interaction of the suspension systems within the car. Spring assemblies for different car types are tuned such that optimum performance is achieved, which may result in a reserve ratio less than 1.50. By reducing the spring assembly reserve capacity for a railcar and truck of a given weight and configuration to less than 1.50, an unexpected result of a decrease in maximum vertical acceleration is achieved. The decrease in vertical acceleration allows for improved ride quality, increased resistance to suspension bottoming and increased hunting threshold speed of the railcar.

As described above, a preferred method of adjusting the reserve capacity of a spring group to less than 1.50, preferably to 1.49 or less, more preferably to within the range of 1.35 to 1.48 or less and/or the range of 1.40 to 1.47 or less, is to reduce the number of inner springs, including inner-inner springs, from the spring assembly previously used for a given railcar that had a spring assembly reserve capacity of greater than 1.50 as required by AAR specifications. Which inner springs, and the number of inner springs, to remove in order to achieve the adjusted reserve capacity at the spring assembly is not particularly limited and can be readily determined for any given type of railcar by a practitioner in the art.

This particular arrangement with the proper coil diameter, spring rod diameter, spring material, and spring height has been found to provide the operational response that contribute to a truck being able to meet AAR truck performance specifications M-976.

This structural arrangement of FIGS. 12 and 15 is not the only spring configuration or arrangement available, but it fulfills the dimensional constraints of sideframe windows 18 and allows for improved ride quality, increased resistance to suspension bottoming, and increased hunting threshold speed of a railroad car. The operating response or characteristic of any spring coil is considered to be a limitation of the coil material, its heat treatment, the diameter of the rod or wire used to make the spring and the length or height of the spring. Therefore, it is considered that it would be conceivable to prepare a spring group 36 of a different configuration and having a different number of springs of different diameter, which spring group would be operable to meet the specification constraints to meet performance requirements, but with a reserve capacity less than 1.50.

Figure 16:
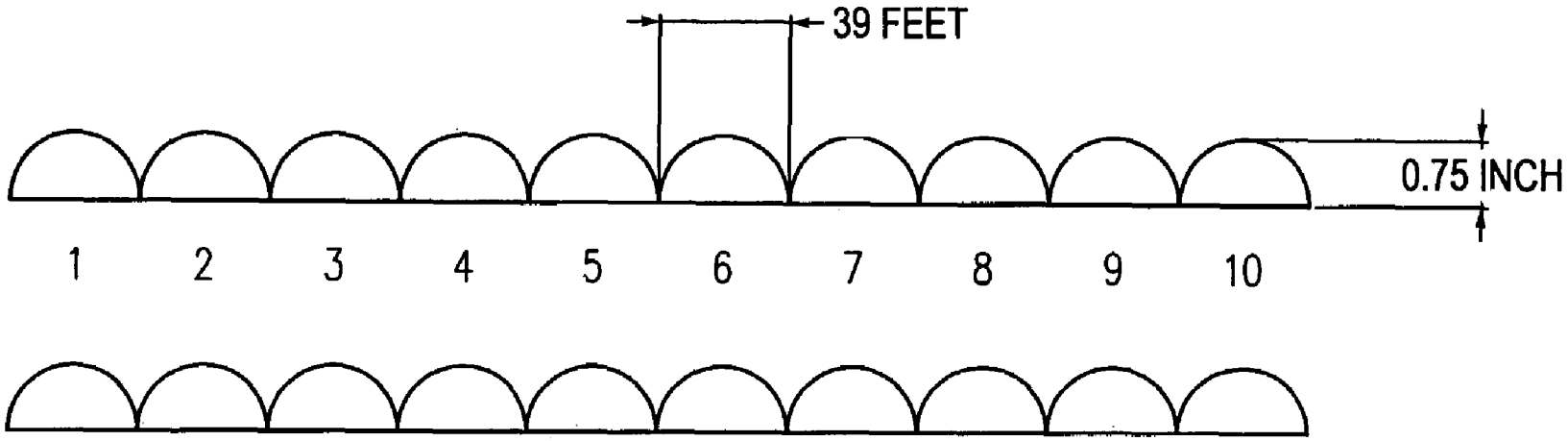
FIG. 16 is an illustration of track surface variation for pitch and bounce.

FIG. 16 illustrates track surface variation for pitch and bounce when a constant damp spring suspension is used with a railway car load of 286,000 pounds. More specifically, the spring group suspension includes a baseline 9 coils with 4700 pound column load and upgrade special 9 coils with 6000 pound load.

Figure 17A:
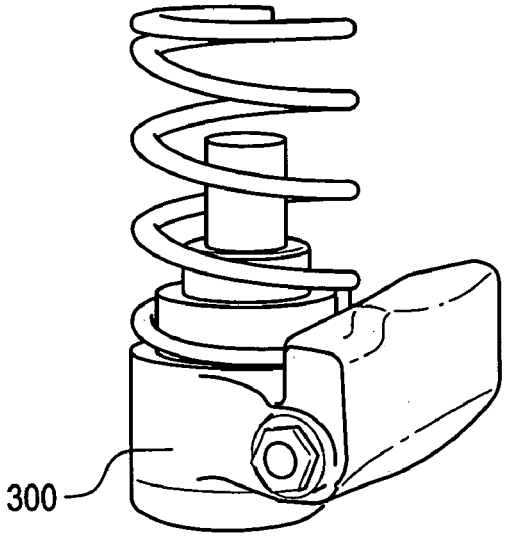
FIG. 17A is an oblique view of a hydraulic snub.
Figure 17B:
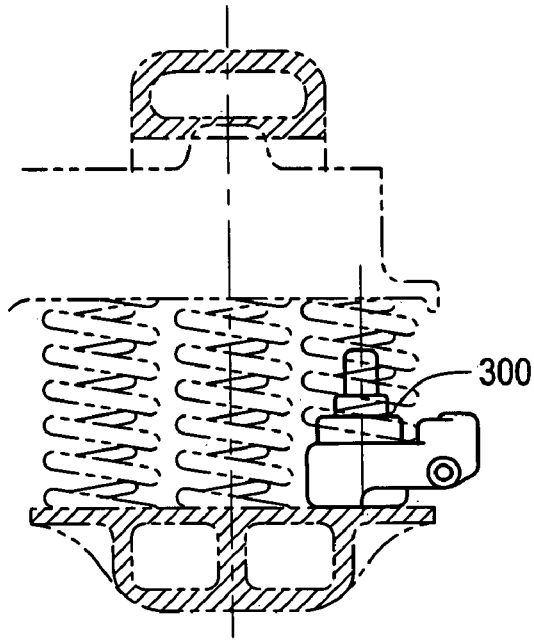
FIG. 17B is an elevational view of the hydraulic snub illustrated in FIG. 17A.
Figure 17C:
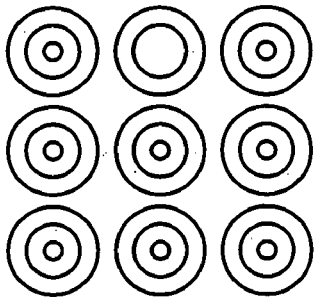
FIG. 17C is a plan view of a coil spring group configuration with a hydraulic snub.
Figure 17D:
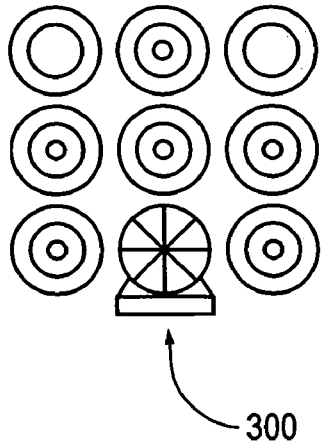
FIG. 17D is a plan view of a coil spring group configuration with a hydraulic snub.
Figure 18A:
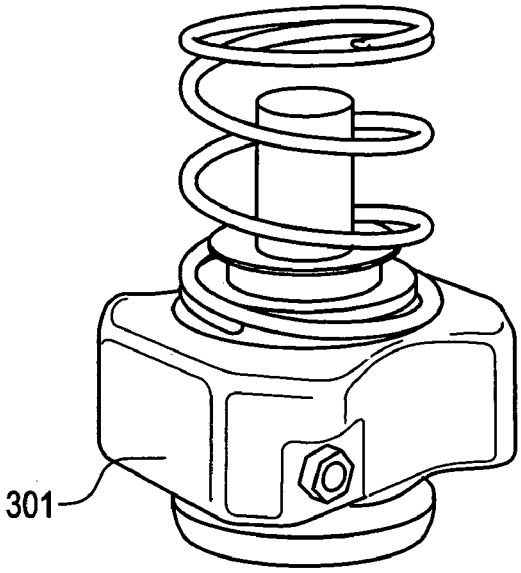
FIG. 18A is an oblique view of a hydraulic snub.
Figure 19A:
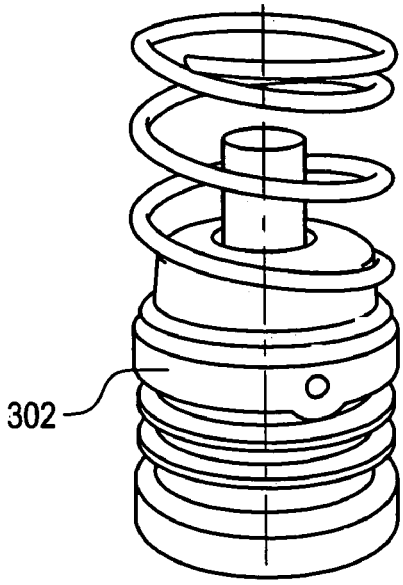
FIG. 19A is an oblique view of a hydraulic snub.
Figure 18B:
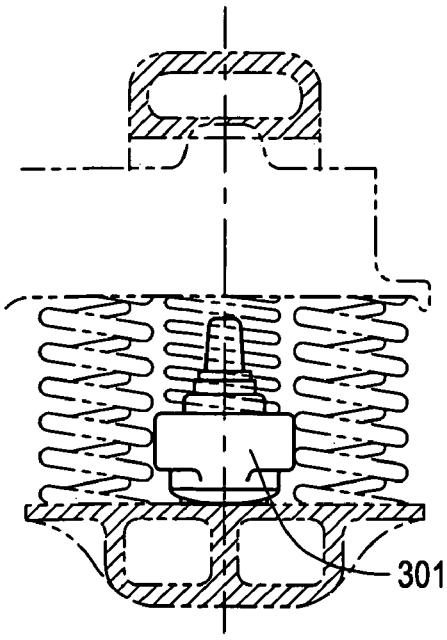
FIG. 18B is an elevational view of the hydraulic snub illustrated in FIG. 18A.
Figure 19B:
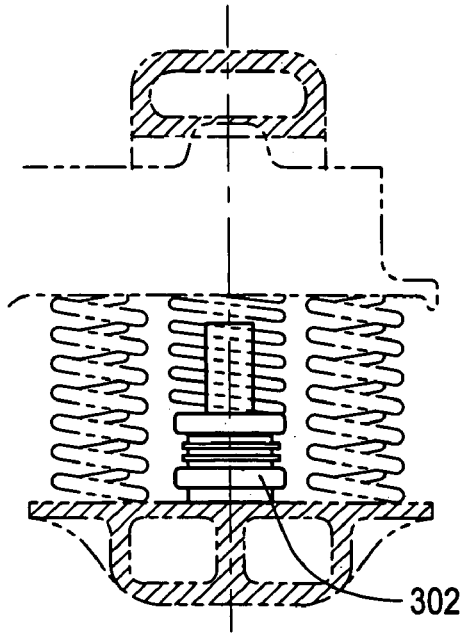
FIG. 19B is an elevational view of the hydraulic snub illustrated in FIG. 19A.
Figure 20:
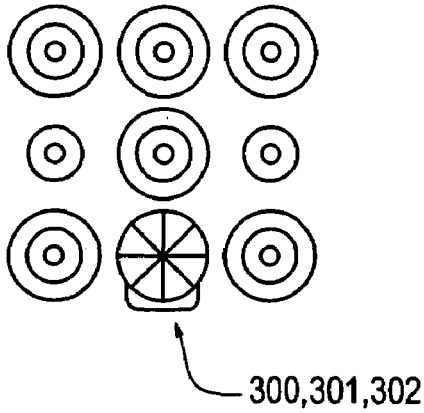
FIG. 20 is a plan view of a coil spring group configuration with a hydraulic snub.
Figure 21:
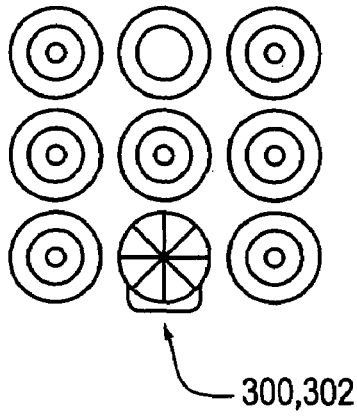
FIG. 21 is a plan view of a coil spring group configuration with a hydraulic snub.
Figure 22:
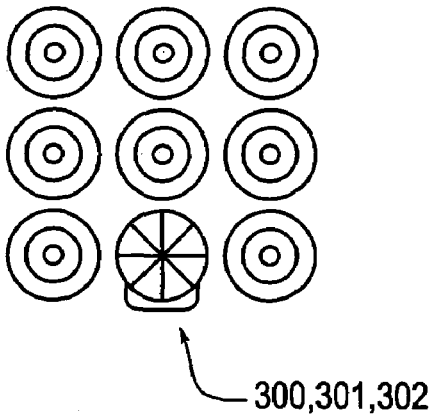
FIG. 22 is a plan view of a coil spring group configuration with a hydraulic snub.
Figure 23:
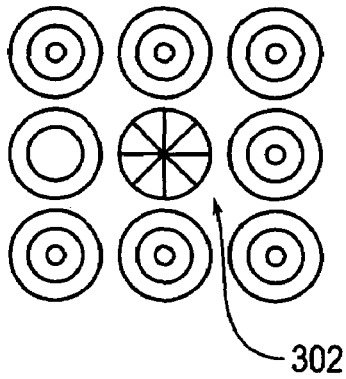
FIG. 23 is a plan view of a coil spring group configuration with a hydraulic snub.
Figure 24:
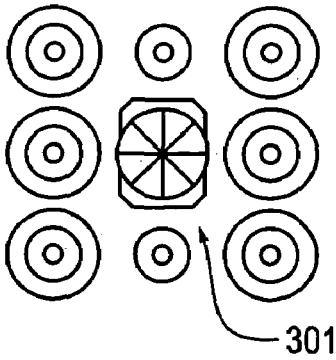
FIG. 24 is a plan view of a coil spring group configuration with a hydraulic snub.
Figure 25:
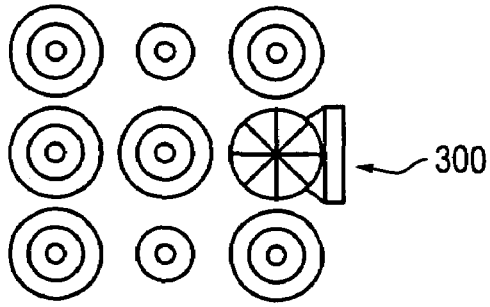
FIG. 25 is a plan view of a coil spring group configuration with a hydraulic snub.
Figure 26:
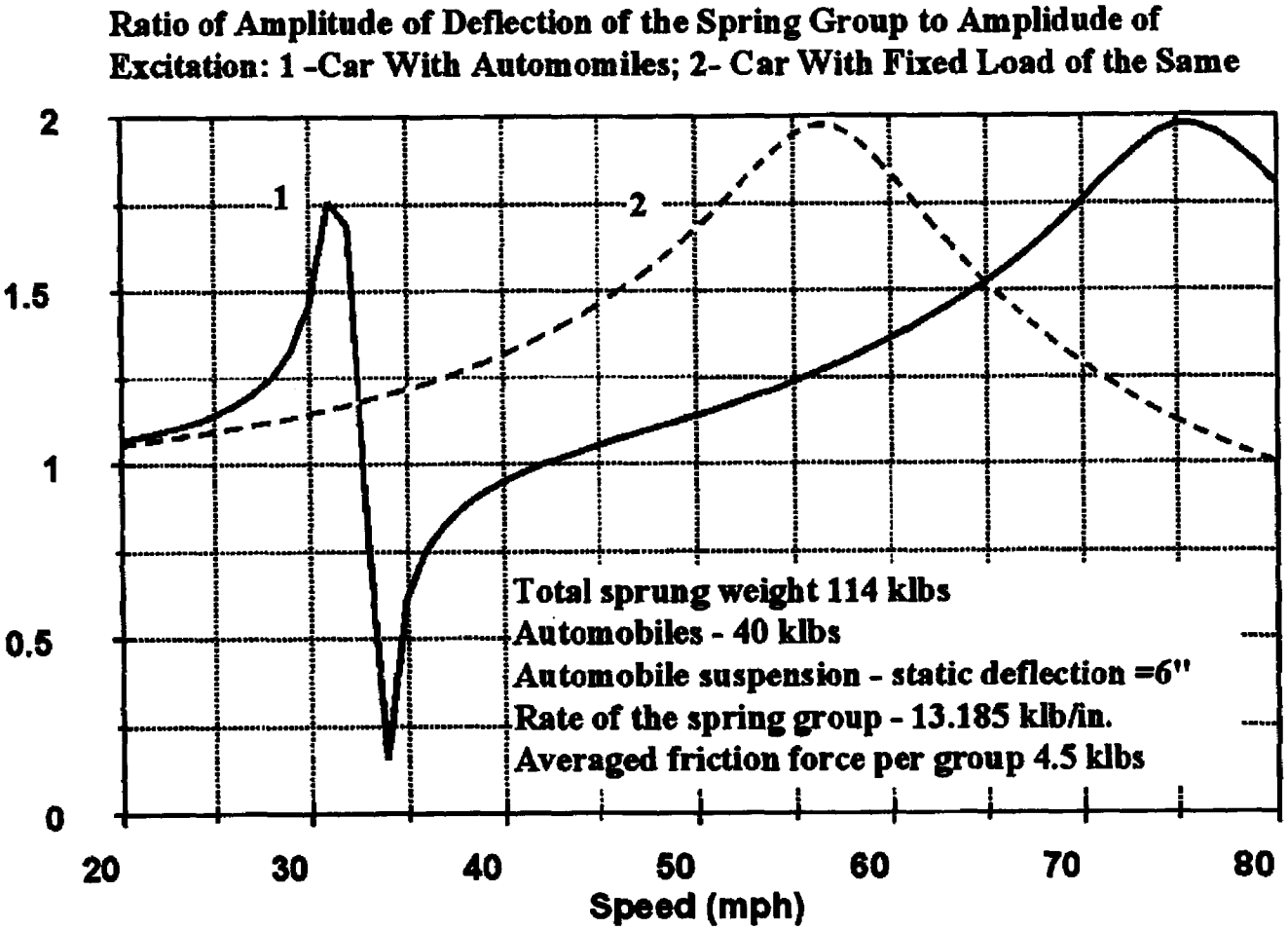
FIG. 26 is a graph illustrating how the natural frequency of bounce of an autorack car splits into two frequencies and illustrates a dynamic effect of this split on the amplitudes of the steady-state vibration.

The use of hydraulic damping in the tuned spring group of the railcar truck can further assure adequate control of adverse loaded car dynamics such as rocking and vertical bounce. FIGS. 17A and 17B illustrate a hydraulic snub 300 that is designed to fit within the spring group assembly by replacing one set of springs of the group at one position. For example, the hydraulic snub 300 may be used with a tuned spring group assembly having 9 outer coils and 7 inner-coils as shown in FIG. 17C. By replacing a combination of one of the outer coils and one of the inner coils with the hydraulic snub 300, as shown in FIG. 17D, such that 8 outer coils and 6 inner coils remain, the reserve capacity of the spring group is still less than 1.50. By further adding the hydraulic snub 300 to the tuned spring group having only 8 outer coils with 6 inner coils, as illustrated in FIG. 17D, the reserve capacity may further be decreased. FIGS. 18A, 18B, 19A and 19B illustrate alternative hydraulic snubs 301 and 302, respectively. FIGS. 20-25 illustrate, for example, other spring group assemblies including a hydraulic snub 300, 301 or 302. It should be recognized that various spring group assemblies with hydraulic snubs may be used and are not limited to the assemblies illustrated herein.

Although replacing a spring or a set of springs with a hydraulic snub or tuning the spring group assembly in combination with use of a hydraulic snub can improve ride quality and reduce reserve capacity, improved ride quality, increased resistance to suspension bottoming, and increased hunting threshold may be more simply achieved by a tuned spring group assembly without hydraulic damping as discussed above.

Those skilled in the art will recognize that certain variations and/or additions can be made in these illustrative embodiments. It is apparent that various alternatives and modifications to the embodiments can be made thereto. It is, therefore, the intention in the appended claims to cover all such modifications and alternatives as may fall within the true scope of the invention.

What is claimed is:

1. A suspension design for a standard capacity railway truck, the suspension design comprising:

a first sideframe and a second sideframe, wherein the first sideframe and the second sideframe are laterally spaced with respect to each other;

an opening in each of the first sideframe and the second sideframe;

a bolster having two end sections and extending laterally between the first sideframe and the second sideframe, wherein one of the two end sections extends through the opening in the first sideframe and another of the two end sections extends through the opening in the second sideframe; and a first suspension system of the first sideframe and a second suspension system of the second sideframe, wherein the first suspension system and the second suspension system provide all the necessary suspension required for the standard capacity railway truck and further wherein the first suspension system and the second suspension system each comprise:

a spring group on a bottom surface of the opening, wherein the spring group supports the bolster, the spring group comprises a plurality of outer springs, and a plurality of inner springs that are each sized to fit inside any of the plurality of outer springs, wherein the plurality of outer springs includes no more than 9 springs and the plurality of inner springs includes no more than 6 springs, the spring group having a reserve capacity less than 1.50.

2. The suspension design for a railway truck of claim 1, wherein the spring group has a reserve capacity of 1.49 or less.

3. The suspension design for a railway truck of claim 1, wherein the spring group has a reserve capacity of 1.35 to 1.48.

4. The suspension design for a railway truck of claim 1, wherein the spring group has a reserve capacity of 1.40 to 1.47.

5. The suspension design for a railway truck of claim 1, further comprising:

a pair of opposing pockets in each of the two end sections of the bolster; and a pair of friction shoes each located in one of the opposing pockets of the bolster and each adjacent to opposing side walls of the opening.

6. The suspension design for a railway truck of claim 1, wherein the railway truck has a weight capacity of 286,000 pounds.

7. The suspension design for a railway truck of claim 6, wherein a maximum vertical acceleration of the railway truck at about 55 miles per hour is about 1.1g.

8. The suspension design for a railway truck of claim 1, wherein the plurality of springs include load springs and control springs.

9. The suspension design for a railway truck of claim 1, wherein the plurality of springs include a plurality of spring sets.

10. The suspension design for a railway truck of claim 9, wherein each of the spring sets include at least one of an inner-inner spring, an inner spring, and an outer spring.

11. The suspension design for a railway truck of claim 9, wherein each of the spring sets includes springs or an hydraulic snub, wherein when the hydraulic snub is included in each of the spring sets, the reserve capacity is less than 1.45.

12. The suspension design for a railway truck of claim 1, wherein the opening is defined by a top surface, a bottom surface, and two laterally spaced column surfaces.

13. The suspension design for a railway truck of claim 12, further comprising:

a plurality of wear plates wherein each of the column surfaces has a wear plate affixed thereto.

14. A method for tuning a spring suspension of a railway truck supported by two laterally spaced sideframes and a bolster extending laterally between and coupled to the sideframes, wherein the sideframes each have an opening therein, the method comprising:

determining a load of the railway truck;

providing a suspension system for the railway truck comprising:

a spring group on a bottom surface of the opening of the each of the sideframes, wherein the spring group comprises a plurality of outer springs, and a plurality of inner springs that are each sized to fit inside any of the plurality of outer springs, wherein the plurality of outer springs includes no more than 9 springs and the plurality of inner springs includes no more than 6 springs, and wherein a configuration of the spring group is such that a reserve capacity of the spring group is less than 1.50 based on the determined load of the railway truck; and removing at least one spring of the plurality of outer springs and the plurality of inner springs to further reduce the reserve capacity of the spring group.

15. The method of claim 14, further comprising:

modifying the configuration of the spring group to reduce the reserve capacity to 1.49 or less.

16. The method of claim 14, further comprising:

modifying the configuration of the spring group to reduce the reserve capacity to a range of 1.35 to 1.48.

17. The method of claim 14, further comprising:

modifying the configuration of the spring group to reduce the reserve capacity to a range of 1.40 to 1.47.

18. The method of claim 14, further comprising:

modifying the configuration of the spring group by removing at least one of the plurality of springs.

19. The method of claim 14, further comprising:

modifying the configuration of the spring group by replacing at least one of the plurality of the springs by a spring of a different type or size.

20. The method of claim 14, further comprising:

modifying the configuration of the spring group by changing the arrangement of at least one of the plurality of springs.

21. A suspension design for a railway truck comprising:

a first sideframe and a second sideframe, wherein the first sideframe and the second sideframe are laterally spaced with respect to each other;

an opening in each of the first sideframe and the second sideframe;

a bolster having two end sections and extending laterally between the first sideframe and the second sideframe, wherein one of the two end sections extends through the opening in the first sideframe and another of the two end sections extends through the opening in the second sideframe; and a first suspension system of the first sideframe and a second suspension system of the second sideframe, wherein the first suspension system and the second suspension system each comprise:

a spring group on a bottom surface of the opening, wherein the spring group supports the bolster, the spring group comprises a plurality of outer springs, and a plurality of inner springs that are each sized to fit inside any of the plurality of outer springs, wherein the plurality of outer springs includes no more than 9 springs and the plurality of inner springs includes no more than 6 springs, and wherein the spring group is a tuned spring group having a reserve capacity less than 1.47;

wherein when the railway truck has a weight capacity of 286,000 pounds, a maximum vertical acceleration of the railway truck at about 55 miles per hour is near 1.1 g.

* * * * *